United States Patent [19]

Levin et al.

[11] Patent Number: 4,646,215

[45] Date of Patent: Feb. 24, 1987

[54] LAMP REFLECTOR

[75] Inventors: Robert E. Levin, S. Hamilton; George J. English, Reading, both of Mass.

[73] Assignee: GTE Products Corporation, Danvers, Mass.

[21] Appl. No.: 770,900

[22] Filed: Aug. 30, 1985

[51] Int. Cl.[4] ..... F21M 3/18; F21V 7/08

[52] U.S. Cl. ..... 362/296; 362/308

[58] Field of Search ..... 362/296, 307, 310, 311, 362/308

[56] References Cited

U.S. PATENT DOCUMENTS

| | | | |
|---|---|---|---|
| Re. 30,832 | 12/1981 | La Giusa | 362/307 X |
| 1,882,647 | 10/1932 | Kanolt | 362/307 |
| 3,871,751 | 3/1975 | Rambauske et al. | 362/296 X |
| 4,439,817 | 3/1984 | Aton | 362/307 X |
| 4,451,873 | 5/1984 | Tyler et al. | 362/296 X |
| 4,481,563 | 11/1984 | Snyder et al. | 362/296 |

FOREIGN PATENT DOCUMENTS

| | | | |
|---|---|---|---|
| 974743 | 10/1950 | France | 362/296 |
| 1350658 | 12/1963 | France | 362/296 |
| 2104530 | 6/1983 | United Kingdom | 362/296 |
| 2123134 | 1/1984 | United Kingdom | 362/296 |

*Primary Examiner*—Carlton R. Croyle
*Assistant Examiner*—Theodore W. Olds
*Attorney, Agent, or Firm*—Lawrence R. Fraley

[57] ABSTRACT

A lamp combination wherein the reflector's reflective surface is of a shape specifically designed to compensate for the refractive effects produced by the thickness of the glass walls of the light source's envelope structure located within (surrounded by) the reflector. Optimum light output is thus assured. A method of making such a lamp is also disclosed.

8 Claims, 9 Drawing Figures

| | X | Y |
|---|---|---|
| (Q) | 1.3266 | 1.2500 |
| | 1.2147 | 1.1966 |
| | 1.1149 | 1.1469 |
| | 1.0256 | 1.1004 |
| | 0.8729 | 1.0159 |
| | 0.7477 | 0.9408 |
| | 0.5987 | 0.8423 |
| | 0.4836 | 0.7573 |
| | 0.3672 | 0.6600 |
| | 0.2806 | 0.5765 |
| | 0.1879 | 0.4705 |
| | 0.1169 | 0.3676 |
| | 0.0666 | 0.2697 |
| (P) | 0.0380 | 0.1874 |

LAMP REFLECTOR

TECHNICAL FIELD

The present invention relates, in general, to a new and improved lamp reflector structure and method of fabricating same. More particularly, the present invention relates to headlamp reflectors for automobiles to provide a substantially collimated forward beam of light and projection lamp reflectors for concentrating a spot of light.

BACKGROUND OF THE INVENTION

Conventional headlight lamps, whether of the sealed beam variety or not, typically utilize a paraboloid reflector with an incandescent filament lamp located at, and centered on, the focal point of the reflector. Recently, the typical incandescent filament lamp used in such headlights includes a tungsten halogen capsule or bulb in which a tungsten filament is contained in a gaseous halogen atmosphere enclosed by a cylindrical glass or quartz envelope.

The function of the paraboloid reflector is to reflect the light emitted from the lamp filament and direct the light rays forward in a collimated beam of substantially parallel rays. Typically, a lenticular lens is disposed forward of the reflector and lamp filament in the path of the parallel light rays. The lens includes an array of lenticules, or lens elements, which isolate pencils of the collimated light beam. These lens elements modifiy such pencils of light in direction and/or distribution to provide the predetermined desired headlamp light distribution pattern.

The most significant portions of the headlamp light distribution pattern are develdoped using the prism power of the lens elements. If the prism power required to deviate the beam is too large, undesirable light dispersion and consequential color banding occurs. Even at lower prism powers, added problems can arise. Offsets, or steps, are typically required between lens elements. The size of these steps increases with prism angle and therefore with prism power. These steps introduce stray light into the beam as a result of surface reflection as well as the prism power of the steps. Large offsets, or steps, are also disadvantageous from the standpoint of glass or plastic fabrication. It is relatively difficult to maintain the quality of molded parts as the depth of offsets becomes appreciable with respect to the total part thickness.

Accordingly, a need exists for a reflector/filament combination which, when used with a lenticular lens array, minimizes the amount of lens element prism power required to obtain the desired headlamp light distribution pattern.

DISCLOSURE OF THE INVENTION

In accordance with a first embodiment of the invention, a modified paraboloidal reflector is provided for a reflector/filament combination wherein the shape of the reflector accommodates for the deviation of light rays caused by the cylindrical bulb wall surrounding the filament. The cylindrical bulb wall of the capsule introduces a deviation such that the light from the paraboloidal reflector for each point on the reflector does not result in a bundle of rays centered in a direction parallel to the optical axis, i.e., the axis of revolution of the reflector. Consequently, these rays do not appear to originate at the focal point and hence are not reflected parallel to the reflector axis. These rays are the central rays of the ray bundles for a finite filament centered on the focal point. If these rays deviate significantly from the axial direction, additional prism power must be incorporated into the lens elements as correction for such deviation. While this can be done, additional prism power is undesirable for the reasons given above.

The present invention compensates for distortion introduced by the lamp capsule envelope by providing a non-paraboloidal reflector contour which takes into account the deviation caused by the lamp envelope enclosing the filament.

The compensated contour is defined by a set of three parametric equations, as follows:

$$K = (T/\tan H)(1 - \sin H/\sqrt{n^2 - \cos^2 H}) \quad \text{A.}$$

$$dy/dx = \tan H/2 \quad \text{B.}$$

$$y = [x - f + K(H)] \tan H \quad \text{C.}$$

wherein:

K is the axial displacement of light rays for a bulb wall of refractive index, n;

H is the angle of a light ray from the axis originating at a point (filament center) on the center line of the reflector axis;

T is the bulb wall thickness;

dy/dx is the instantaneous slope of the reflector contour required to achieve a collimated beam; i.e., reflection parallel to the axis; and f is the distance from the origin of coordinates to the center of the filament.

At this juncture in the description, it is appropriate to note that while the invention has thus far been described in the context of automobile headlamp technology, it has far more general applicability. For example, spotlights, searchlights and projection lamps may use paraboloidal reflectors to produce reflected narrow beams of light. The performance of such devices can be greatly enhanced by incorporating the teachings of the invention to prevent beam spread caused by non-parallel rays emanating from the central region of the beam.

Furthermore, the principles underlying the non-paraboloidal embodiment disclosed above may be extended to provide a modified ellipsoidal reflector embodiment for light projection, as will be explained in detail in connection with the drawings.

BEST MODE FOR CARRYING OUT THE INVENTION

For a better understanding of the present invention, together with other and further objects, advantages and capabilities thereof, reference is made to the following disclosure and appended claims in connection with the above-described drawings.

A first embodiment of the invention relates to modification of the typical paraboloidal reflector structure. Therefore, to explain the invention properly, it is believed necessary to first briefly review the principles of such a structure, indicating failings and shortcomings thereof, and how these problems are solved or avoided by the present invention.

Figure 1:
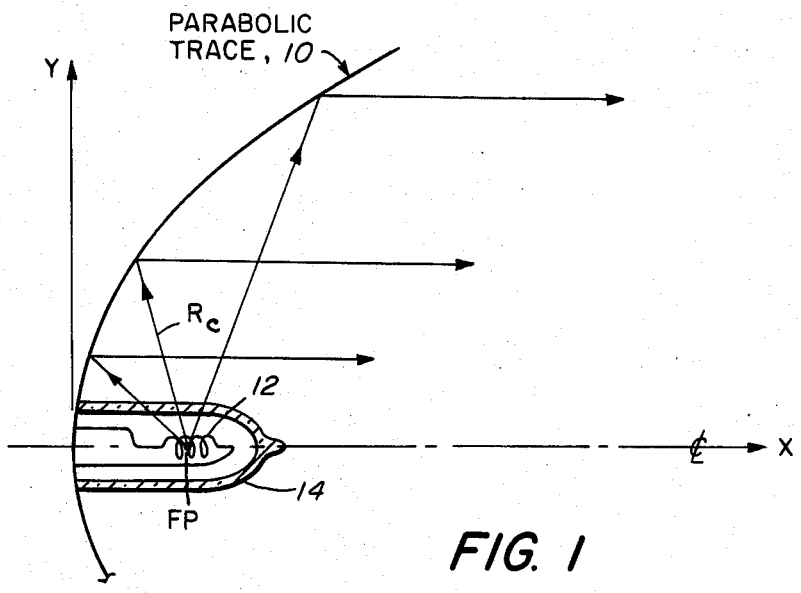
FIG. 1 represents the top half of the parabolic trace (generatrix) of a meridional plane section through a paraboloidal reflector, with a representative light source superimposed in schematic form thereon.

Referring with particular attention to FIG. 1, there is shown the upper one-half of the parabolic trace 10, or generatrix, of a meridional plane section through a paraboloidal reflector. A typical incandescent lamp filament 12 enclosed in a substantially cylindrical, vitreous (e.g., glass or quartz) envelope 14 is shown in schematic form with the filament 12 located at, and centered on, the focal point FP of the reflector. Ray $R_c$ represents a central ray of a bundle of rays that would generate from focal point FP as a result of filament 12 being centered on the focal point. Neglecting the refraction effect of the material of cylindrical capsule wall 14, all of these rays are reflected substantially parallel to the reflector axis as shown.

Figure 2:
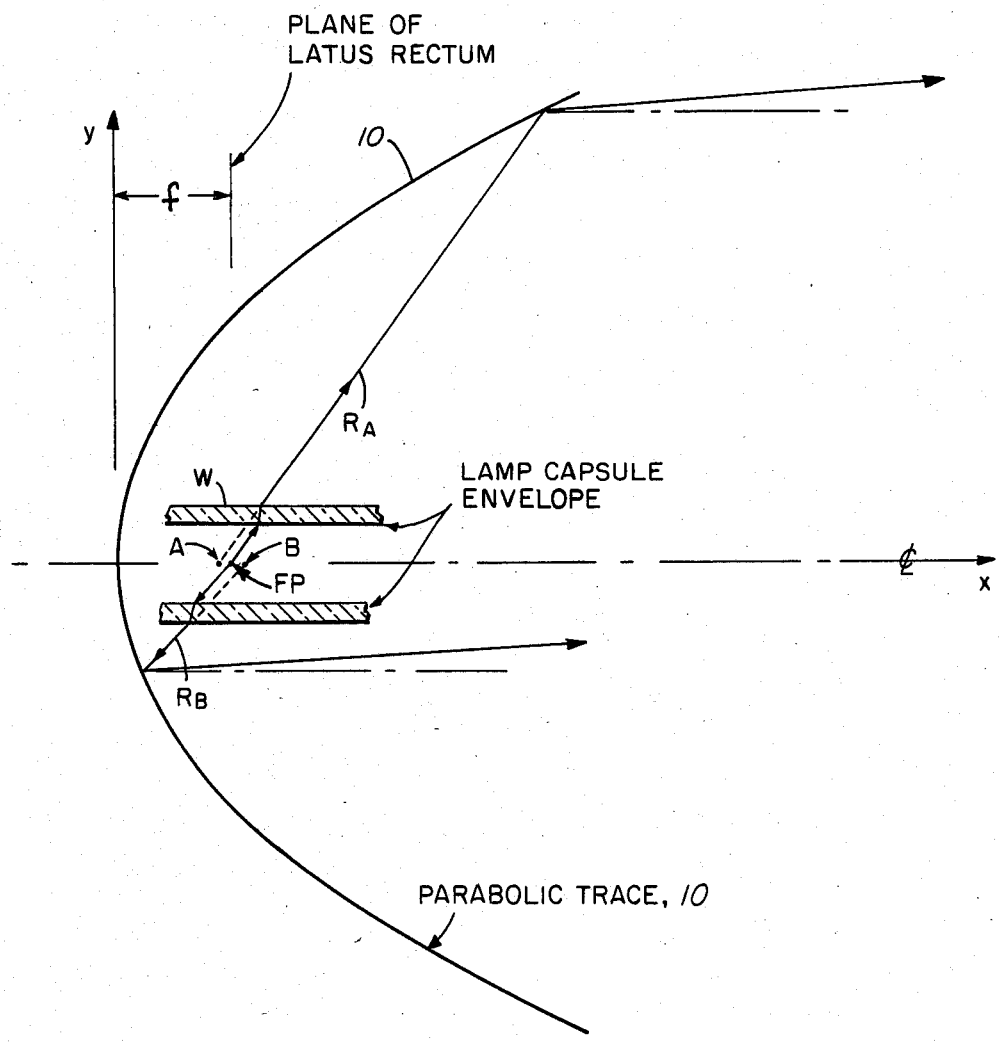
FIG. 2 is an enlarged schematic view of a portion of the bulb wall of the light source superimposed on the parabolic trace of FIG. 1.

In FIG. 2, an enlarged portion of the cross-section of the cylindrical light capsule envelope 14 is shown. Filament 12 is not shown and the thickness of wall W is exaggerated for clarification purposes. It must be noted that rays $R_A$ striking the reflector ahead of the plane of the latus rectum (normal to the center line and containing the focal point) appear to originate behind the focal point FP, as at A, while rays $R_B$ striking the reflector behind the latus rectum appear to originate ahead of the focal point, as at B. This is caused by refraction of the rays as they enter walls of the light capsule envelope 14. Since these rays do not appear to originate at the focal point FP, they are thus not reflected parallel to the reflector axis. Understandably, these raays represent central rays of ray bundles for a finite filament centered on the illustrated focal point. When such rays deviate significantly from the axial direction, additional prism power must be employed, typically in the form of lens elements (not shown) forward of the reflector, to provide necessary correction for such deviation.

Figure 3:
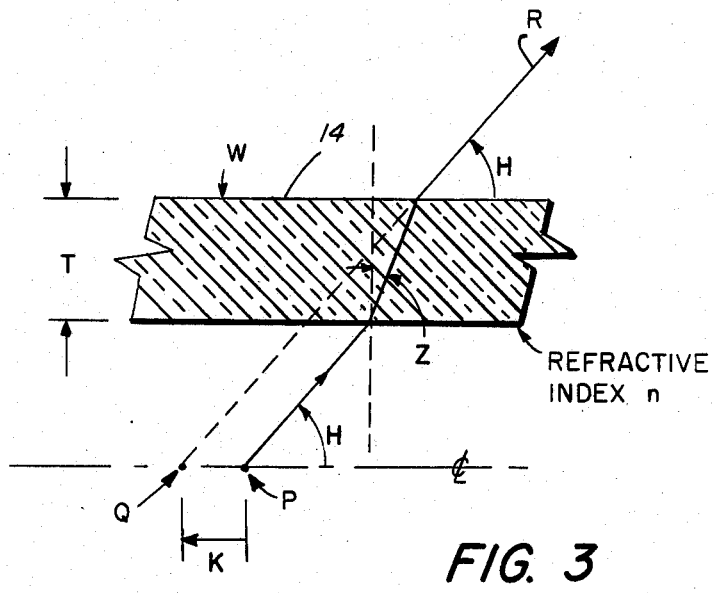
FIG. 3 is an enlarged cross-sectional view of a portion of an envelope bulb wall showing the refraction of light rays in more detail.

The present invention, as disclosed herein, provides for modification of the paraboloidal reflector's concave contour to compensate for the distortion introduced by the lamp capsule envelope. This concave contour is defined by a set of parametric equations which will be explained in connection with FIG. 3. FIG. 3 represents a more enlarged, partial sectional view of a cross-section of the bulb wall W of the light source capsule 14. FIG. 3 shows ray R originating at point P on the reflector's centerline CL and forming an angle H with the centerline. The bulb wall W of the capsule envelope 14 has a designated thickness T which causes deviation of ray R such that it appears to originate at point Q on the centerline, instead of at P.

In accordance with Snell's law:

$$\cos H = n \sin Z;$$

wherein $\pi/2 - H$ = the angle of incidence;

n = the index of refraction of the wall material; and

Z = the angle of refraction.

The above will be referred to as Equation 1.

Furthermore, the geometry of the structure is such that:

$$K = T/\tan H - T \tan Z;$$

wherein K = the axial displacement of a ray for a bulb wall of refractive index n; and T = the thickness of the bulb wall.

This will be referred to as Equation 2.

Therefore, by substituting Z as defined by Equation 1 into Equation 2, the axial displacement K caused by the bulb wall refraction may be defined in terms of T, H and n as follows:

$$K = (T/\tan H)[1 - \sin H/\sqrt{n^2 - \cos^2 H}\ ]$$

Such axial displacement is hereinafter referred to as Equation 3.

The equation for the trace, or generatrix, of the refraction correcting reflector is then given in the form of parametric differential equations as:

$$dy/dx = \tan H/2$$

(hereinafter Equation 4); and $$y = [x - f + K(H)] \tan H$$

(hereinafter Equation 5); wherein f is the distance from the origin of coordinates to the center of the filament.

Equations 3, 4, and 5 comprise a set of parametric equations which define a family of curves that can be used to specify the requisite concave reflector contour capable of correcting for refraction caused by the adjacent light bulb wall (envelope). It is thus only necessary to specify scale by initial conditions, for example, by defining a point of the curve. This set of three parametric equations can be solved using established numerical techniques. It must be noted that it is only necessary to consider the meridional plane with regard to prism distortion since the system is bilaterally symmetric when viewed in the sagittal plane.

Figure 4:
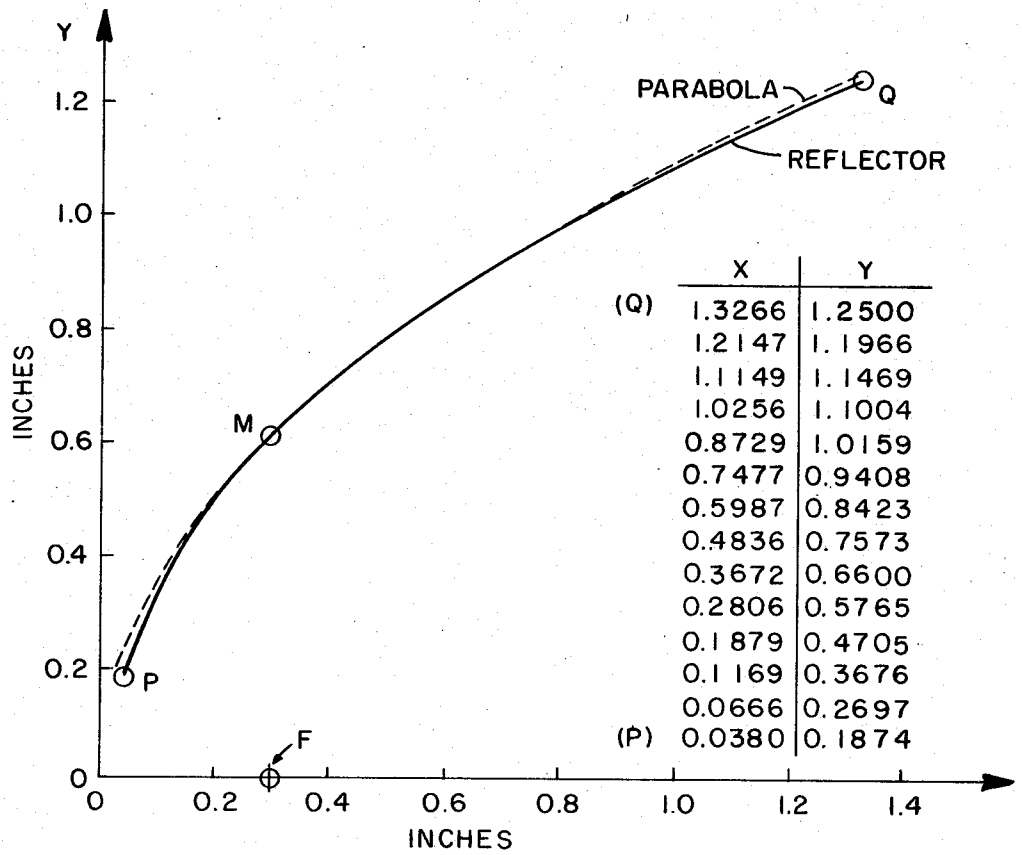
FIG. 4 is an x-y plot of the contour of a compensated reflector (solid line) as taught herein wherein the light source is centered at F, the bulb wall thickness T is a specific amount (0.061 inch) and the bulb wall material has a particular index of refraction (1.50)

FIG. 4 shows in solid lines an example of the dimensions of a reflector made in accordance with the invention for a filament light source centered at F, in which the bulb wall thickness T is 0.061 inch and the bulb wall material has a refractive index n of 1.50. The departure from a parabola (shown in dotted lines) is illustrated by the parabola whose focal point is at F and passing through the reflector on the latus rectum at M. The deviation from collimation for a parabola at point P would be 5.6° and at point Q would be 0.6°, due to bulb wall refraction. The demonstrated reflector (solid line)

has substantially zero deviation from collimation for the central ray of the reflected ray bundles at all points.

Figure 5:
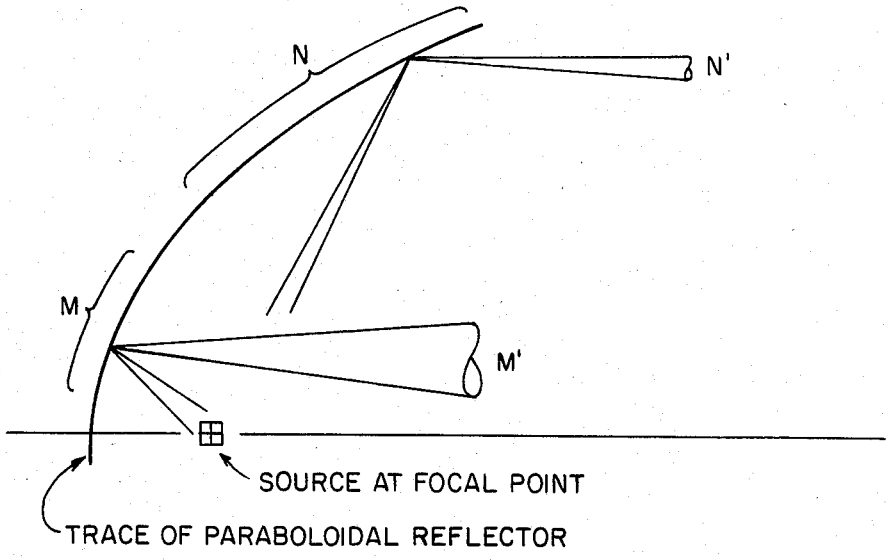
FIG. 5 shows in schematic form a sectional view of the upper half of a spotlight reflector and beam path.

It is important to note again that the application of this invention is not limited exclusively to vehicle headlamps. Reflective narrow beam spotlights, for example, produce an extremely narrow beam when, as seen from the reflector, the light source is at a fixed location (point). Such would be the case for cylindrical shaped lamp bulbs and for the electrode crater of arc sources. The beam (intensity distribution) of such spotlights is roughly Gaussian in shape with the peak distribution centered on the reflector center line. A section view of a spotlight (FIG. 5) shows that the inherent spread of elemental beams M′ from the central region M is greater than the spread of those beams N′ from the peripheral region N due to the lesser radius vector in the central region. Thus, the peripheral region N of the reflector only contributes to the central high intensity region of the beam while the central region M contributes to the "tails", or wide spread region, of the beam. Consequently, if the central rays of the beam pencils, such as M′, are not parallel to the optic axis, undesirable total spotlight spread is increased significantly. It is precisely these regions which are affected by refraction from cylindrical lamp bulb envelopes since at these oblique angles the image displacement is greatest. For this reason, the present invention is of particular value for tungsten halogen spotlights where the bulb envelope is generally a relatively thick, axially oriented cylinder.

Referring again to FIG. 3, it should be noted that, as seen from the reflector, the axial displacement K of the source image from the true source position is zero for H=90° (i.e., viewing from the reflector at a point on the latus rectum). The axial displacement increases with either an increase or decrease in the angle H from 90°.

Figure 6:
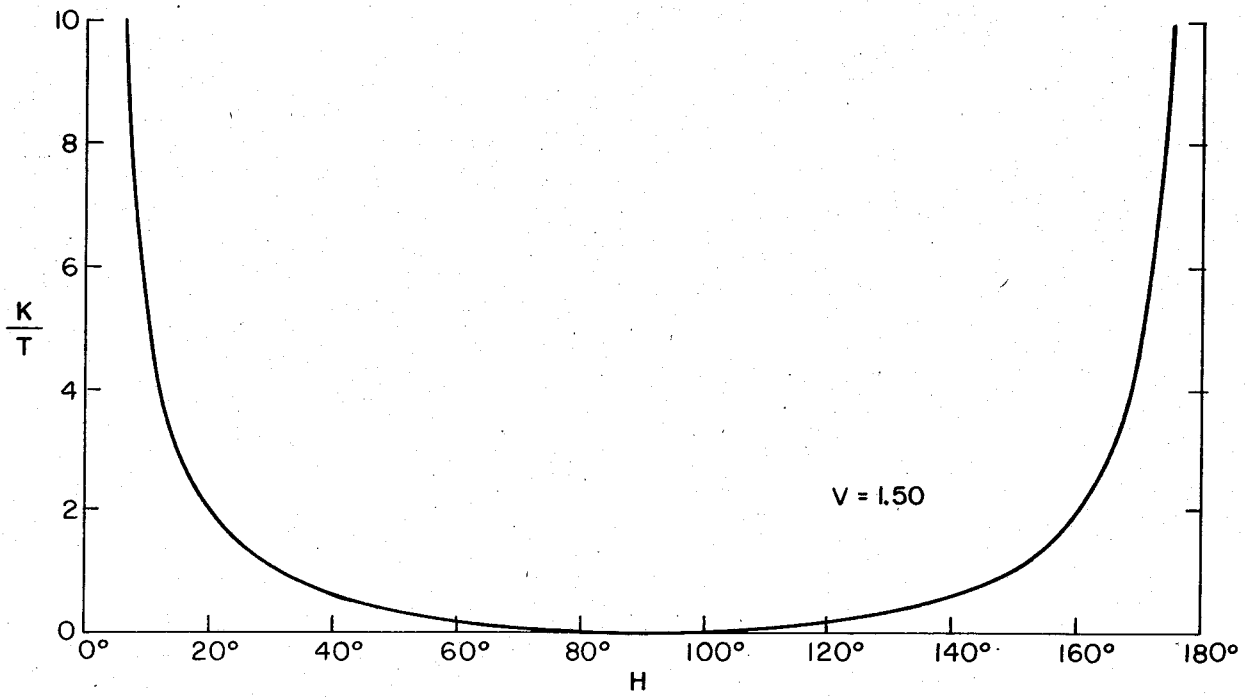
FIG. 6 is a plot of the axial displacement normalized to bulb wall thickness K/T versus angle of incidence (H)

FIG. 6 is a plot of K/T (the axial displacement normalized to bulb wall thickness) versus H. From FIG. 6, it is clear that the displacement K will be substantially negligible in the vicinity of 90°. The angular range over which such displacement is negligible depends on the bulb wall thickness and the significance of image displacement in the specific application. This indicates that an annular ring of the reflector can be paraboloidal in the vicinity of the latus rectum without degradation of performance. Consequently, a practical variation of the present invention can include a reflector having a surface generated by a generatrix which is parabolic in the central region and departs from a parabolic surface only at the end portions thereof.

Referring again to FIG. 4, it should be noted that the two curves are substantially the same over the respective central portions. Consequently, the scope of this invention also includes the practical variation wherein contour correction is only provided over portions of the reflector where error using a truly parabolic shape becomes significant. Further, such corrections can either be continuous or in discrete steps along the curve.

The principles set forth above for modifying parabolic reflector contours to correct for bulb wall refraction can also be applied to ellipsoidal or other reflector contours, as will be described in connection with FIG. 7 wherein like parts carry the same numeral designation as above but include a prime suffix.

Figure 7:
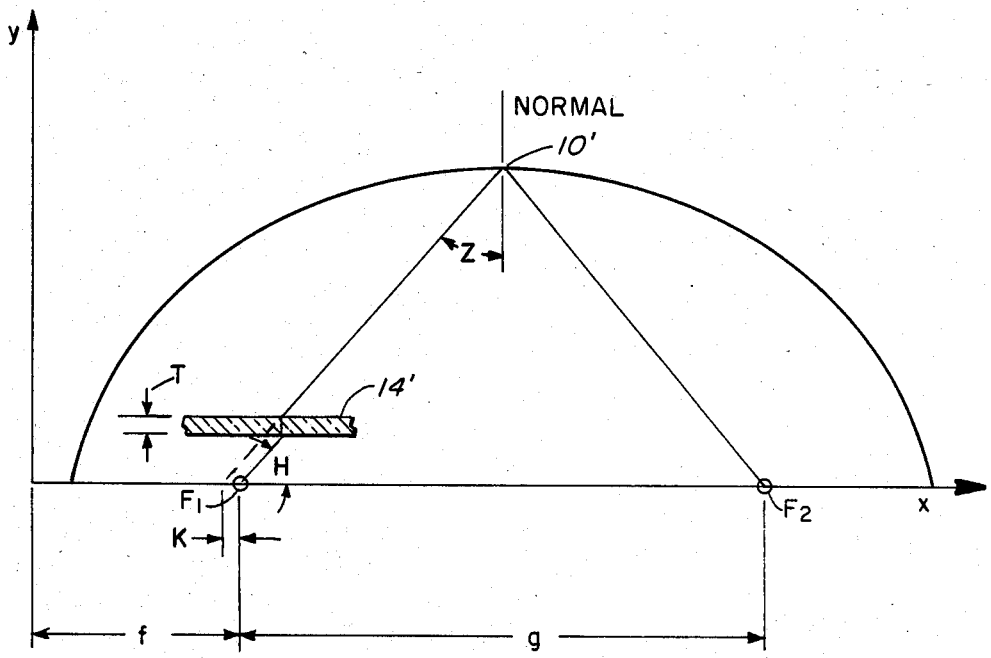
FIG. 7 is a trace of a bulb wall refraction corrected ellipsoidal reflector.

FIG. 7 shows the trace 10′ for a bulb wall refraction corrected ellipsoidal reflector. The function of a typical ellipsoidal reflector is to concentrate light from a relatively small source onto the smallest region of space. Such reflectors are useful, for example, in projection lamps such as are currently found in many of today's slide projectors. As shown in FIG. 7, the light source, i.e., the filament, and the point of concentration are located at the respective conjugate focii ($F_1$ and $F_2$) of the ellipsoid. When the light source is an incandescent filament axially oriented in a cylindrical envelope 14′ (only one wall shown), refraction caused by the envelope's quartz or glass material causes ray divergence and consequent reduction of the concentration of light at $F_2$.

The present invention corrects the contour of such an ellipsoidal reflector in order to compensate for the envelope effect refraction by providing a reflector contour defined by four parametric equations. Two of these equations are the Equations 3 and 5 specified above in connection with the compensated paraboloidal reflector.

The other two equations, referred to as Equations 6 and 7, are, respectively:

$$dy/dx = -ctn\ (H+Z);$$

wherein dy/dx is the instantaneous slope of the curve required to concentrate the central ray from focal point $F_1$ into conjugate focal point $F_2$;

H=the angle of a light ray originating at a point on the centerline of the reflector axis as measured from the optical axis as the ray enters the bulb wall 14′; and Z=the angle of incidence (and reflection) of the ray reflected from the contour 10′ measured to a line normal to the x-axis, and $$\sin 2Z = (g+K)\ [(f+g-x)^2+y^2]^{-\frac{1}{2}} \sin H;$$

wherein f is the distance from the origin of the coordinates to the light source focal point $F_1$; and g is the distance between conjugate focii $F_1$ and $F_2$.

Figure 8:
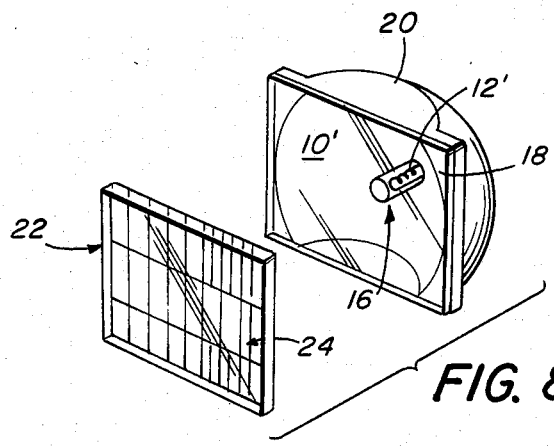
FIG. 8 is an exploded perspective view of an automobile headlamp lighting system incorporating the compensated reflector of the invention.
Figure 9:
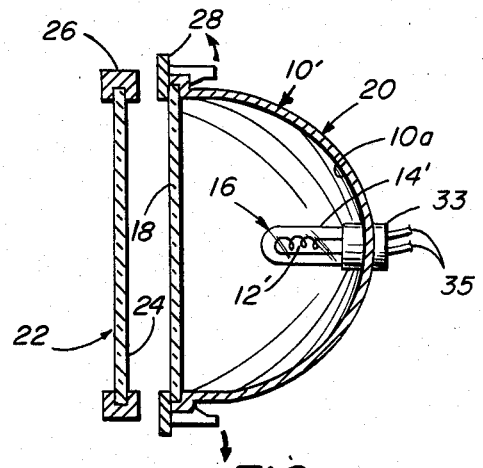
FIG. 9 is an enlarged cross-sectional view of the system of FIG. 8.

Referring now to FIGS. 8 and 9, the compensated reflector of the invention will be shown in a typical application, i.e., an automobile lighting system. FIG. 8 represents an exploded perspective view and FIG. 9 represents a cross-sectional view showing the positional arrangement of the respective components. As illustrated in FIG. 8, the lighting system basically comprises a plurality of replaceable, sealed reflector-capsule lighting modules (only one shown), one of which is shown at 20. The system further includes a plurality of lens member 22 each having either an internal or external lens surface 24 for directing the light emitted from the module and passing through the lens in a forward direction in accordance with a pre-established pattern. The various lens elements forming surface 24 are preferably located internally (toward the module reflector) to prevent dirt build-up thereon. The system is thus one for providing forward illumination for a motor vehicle when suitably positioned therein. Such a system may include a total of eight (four per side) of such modules.

FIG. 9 illustrates one of the modules 20 of FIG. 8 in a cross-sectional view, the module comprising a reflector 10′ having a compensated reflector surface **10*a*, a light capsule 16 mounted in the reflector, and a means for enclosing and sealing the module, illustrated in FIGS. 8 and 9 as an optically clear planar cover 18. Lens 22** is shown as being located at a spaced distance from the respective cover.

The lighting capsule 16 comprises a cylindrical glass or quartz envelope 14' enclosing a tungsten filament 12'. The cylindrical wall of capsule 16 is aligned with reflector surface 10a such that the filament 12' is located and centered on the focal point of the reflector surface. The cover 18 is hermetically sealed at its entire perimeter to the reflector (e.g., by means of an appropriate adhesive). FIG. 9 also shows a means 26, which may be in the form of a support bracket, for retaining the lens member 22 in proper position within the motor vehicle (not shown). FIG. 9 also illustrates means 28, which may also constitute a support bracket, for supporting the module 20 within said vehicle. The module 20 is preferably supported in an easily releasable mounting arrangement to thus facilitate replacement. Preferably, a mechanical seal (not shown) is provided between the lens 22 and the capsule-reflector module 20 to protect the rear lens surface 24. The tungsten halogen light capsule 16 is hermetically sealed through the rear wall of the reflector 10'. This is accomplished by providing two relatively small apertures (not shown) within the reflector's rear wall and inserting each of the capsule's two conductive, metallic lead-in wires (or supporting wires secured thereto, if desired) within a respective one of these apertures. Thereafter, ultrasonic welding can be employed to hermetically seal the plastic reflector material about each wire. The material for reflector 10' is preferably plastic, and even more preferably a polycarbonate (i.e., a plastic sold under the trademark Lexan by the General Electric Company). Another plastic suitable for the reflector is a mineral-filled nylon. The clear cover 18, which preferably does not include any lensing elements on either side (or as part thereof), may also be comprised of the aforementioned Lexan polycarbonate. As an alternative, the tungsten halogen capsule 16 may be sealed in the reflector utilizing an insulative (e.g., plastic) base (or socket) 33 and hermetically sealing (e.g., also by ultrasonic welding) the lead-in wires therein. This base 33 can then be sealed (e.g., using a suitable epoxy) within the rear of the plastic reflector after placing the base within a suitable opening provided therein. The pair of conductors 35 projecting from the base are adapted for being electrically connected to the vehicle's power source.

The tungsten halogen capsule 16 may be one known in the art. Typically, such a capsule comprises a quartz glass envelope having a pinch (press) sealed end through which the filament's lead-in wires (e.g., nickel or molybdenum) pass. The coiled (or coiled-coil) filament 12', being of tungsten, is electrically connected within the capsule to each lead-in wire (or an extension thereof). The halogen cycle is known in the lighting art and further explanation is thus not deemed necessary. Examples of tungsten halogen lamps are shown in U.S. Pat. Nos. 4,126,810, 4,140,939, 4,262,229 and 4,296,351. The capsules of the instant invention, having only one filament therein, each include only two lead-in wires for being connected to the filament and for projecting externally of the envelope's press sealed end.

In accordance with the invention, the contour of reflector surface 10a is shaped, such as by using well-known molding processes, in accordance with the aforementioned Equations 3, 4 and 5 to compensate for refraction in the bulb wall 14' of the lighting capsule whereby light rays from filament 12' are reflected in parallel rays toward lens 22, thereby reducing the amount of prism power needed to deviate the rays passing through lens 22. Optimum output is thus provided, enabling usage of reflector-lamp products possessing smaller overall volumes than heretofore known products. In addition, mass production is assured (thus enabling lower costs) due to the ability to provide several reflectors of similar configuration adapted to accommodate a corresponding number of substantially identical (in overall length, diameter and wall thickness) lamp capsules. Should the end product require a capsule having alterations to one or more of these parameters, a new reflector can be readily produced in accordance with the teachings herein.

While there have been shown and described what are at present considered the preferred embodiments of the invention, it will be obvious to those skilled in the art that various changes and modifications may be made therein without departing from the scope of the invention as defined by the appended claims.

What is claimed is:

1. A lamp comprising:

a source of light enclosed in a transparent, walled envelope having a wall thickness T and an index of refraction n; and a reflector having a reflective surface for collimating the light rays from said source of light located within said reflector and possessing a predetermined shape which compensates for the light ray refraction caused by said walled envelope as said light from said source of light passes therethrough to thereby provide optimum light output from said lamp, said light ray refraction compensation being provided by said reflective surface of said reflector and not by the utilization of open spaces or the like therein, said shape of said reflective surface being defined by Equations A, B and C below:

$$K = (T/\tan H)(1 - \sin H/\sqrt{n^2 - \cos^2 H}); \quad \text{A.}$$

$$dy/dx = \tan H/2; \text{ and} \quad \text{B,}$$

$$y = [x - f + K(H)] \tan H, \quad \text{C,}$$

wherein

K is the axial displacement of said light rays for said envelope having said refractive index, n;

H is the angle of a light ray from an axis originating at a point on the center line of the axis of said reflector as it enters said envelope;

T is said envelope wall thickness;

dy/dx is the instantaneous slope of the reflector surface required to achieve a collimated beam; and f is the distance from the origin of coordinates to the axial center of said source of light.

2. A lamp combination comprising:

a lighting capsule having a filament longitudinally disposed within and enclosed in a substantially cylindrical envelope having a wall thickness T and an index of refraction n; and a reflector disposed adjacent said lighting capsule such that said filament of said capsule is centered on the focal point of said reflector, said reflector having a concave reflective surface with at least a substantial portion of said surface being defined by Equations A, B and C below:

$$K = (T/\tan H)(1 - \sin H)/\sqrt{n^2 - \cos^2 H}); \quad \text{A.}$$

$$dy/dx = \tan H/2; \text{ and} \quad \text{B,}$$

$$y = [x - f + K(H)] \tan H. \quad \text{C,}$$

wherein

K is the axial displacement of light rays for said envelope having said refractive index, n;

H is the angle of a light ray from an axis originating at a point on the center line of the axis of said reflector as it enters said envelope;

T is said envelope thickness;

dy/dx is the instantaneous slope of said reflector surface required to achieve a collimated beam; and f is the distance from the origin of coordinates to the axial center of said lighting capsule.

3. The lamp combination according to claim 2 wherein the surface portions of said reflector defined by said Equations A, B and C are located before and after a location on the contour defined by the intersection of a line located at an angle of substantially ninety degrees from the centerline of the reflector surface and through the focal point of said reflector.

4. The lamp combination according to claim 2 further including a clear cover disposed forward of and enclosing said reflector and lighting capsule, and a light directing lens disposed adjacent to, and forward of, said clear cover for directing collimated light from said reflector in a predetermined direction or pattern.

5. A lamp comprising:

a source of light enclosed in a transparent walled envelope having a wall thickness T and an index of refraction n; and a reflector having conjugate focal points and a reflecting surface possessing a predetermined reflective shape for concentrating light from said light source when said source is located at a first of said focal points to said conjugate focal point, wherein said reflective shape of said reflective surface compensates for the light ray refraction caused by said walled envelope as said light from said filament passes through said envelope to thereby provide optimum light output from said lamp, said light ray refraction compensation being provided by said reflective surface of said reflector and not by the utilization of open spaces or the like therein, said shape of said reflective surface being defined by Equations A, B, C and D below:

$$K = (T/\tan H)(1 - \sin H/\sqrt{n^2 - \cos^2 H}); \quad \text{A.}$$

$$dy/dx = -ctn\,(H+Z); \quad \text{B,}$$

$$Y = [x - f + K(H)] \tan H; \text{ and} \quad \text{C,}$$

$$\sin 2Z = (q+K)\,[(f+q-x)^2 + y^2]^{-\frac{1}{2}} \sin H, \quad \text{D,}$$

wherein

K is the axial displacement of said light rays for said envelope having said refractive index, n;

H is the angle of a light ray originating at a point on the center line of the axis of said reflector as measured from the optical axis as said ray enters said envelope;

T is said envelope wall thickness;

dy/dx is the instantaneous slope of said reflector surface required to achieve a collimated beam;

Z is the angle of incidence and reflection of a ray reflected from said reflector measured to a line normal to the x-axis;

f is the distance from the origin of coordinates to the axial center of said source of light; and g is the distance between said conjugate focal points.

6. A lamp combination comprising:

a lighting capsule having a filament longitudinally disposed within and enclosed in a substantially cylindrical envelope having a wall thickness T and an index of refraction n; and a reflector disposed adjacent said lighting capsule such that said filament of said capsule is centered on a first focal point of said reflector, said reflector having a concave reflective surface with two conjugate focal points and at least a substantial portion of said surface defined by the Equations A, B, C and D below:

$$K = (T/\tan H)(1 - \sin H/\sqrt{n^2 - \cos^2 H}); \quad \text{A.}$$

$$dy/dx = -ctn\,(H+Z); \quad \text{B,}$$

$$y = [x - f + K(H)] \tan H; \text{ and} \quad \text{C,}$$

$$\sin 2Z = (g+K)\,[(f+g-x)^2 + y^2]^{-\frac{1}{2}} \sin H. \quad \text{D,}$$

wherein

K is the axial displacement of light rays for said envelope of having said refractive index n;

H is the angle of a light ray originating at a point on the center line of the axis of said reflector as measured from the optical axis as said ray enters said envelope;

T is said envelope thickness;

dy/dx is the instantaneous slope of said reflector surface required to achieve a collimated beam;

Z is the angle of incidence and reflection of a ray reflected from said reflector measured to a line normal to the x-axis;

f is the distance from the origin of coordinates to the axial center of said source of light; and g is the distance between said conjugate focal points.

7. A method of forming a light concentrating reflector for a light source enclosed within a walled envelope capsule, said method comprising the steps of:

determining the index of refraction, n, of the material of said envelope;

determining the thickness, T, of said envelope;

forming at least a substantial portion of the surface of said reflector in accordance with the Equations A, B and C below:

$$K = (T/\tan H)(1 - \sin H/\sqrt{n^2 - \cos^2 H}); \quad \text{A.}$$

$$dy/dx = \tan H/2; \text{ and} \quad \text{B,}$$

$$y = [x - f + K(H)] \tan H. \quad \text{C,}$$

wherein

K is the axial displacement of light rays for said envelope having said refractive index, n;

H is the angle of a light ray from an axis originating at a point on the center line of the axis of said reflector as it enters the envelope;

T is the envelope thickness;

dy/dx is the instantaneous slope of the reflector surface required to achieve a collimated beam; and f is the distance from the origin of coordinates to the axial center of the source of light.

8. A method of forming a light concentrating reflector having conjugate focal points for a light source enclosed in a walled envelope capsule, said method comprising the steps of:

determining the index of refraction, n, of the material of said envelope;

determining the thickness, T, of said envelope;

forming at least a substantial portion of the surface of said reflector in accordance with the Equations A, B, C and D below:

$$K = (T/\tan H)(1 - \sin H/\sqrt{n^2 - \cos^2 H}); \quad \text{A.}$$

$$dy/dx = -ctn\,(H+Z); \quad \text{B,}$$

$$y = [x - f + K(H)]\tan H; \text{ and} \quad \text{C,}$$

$$\sin 2Z = (g+K)\,[f+g-x)^2 + y^2]^{-\frac{1}{2}} \sin H, \quad \text{D,}$$

wherein

K is the axial displacement of light rays for said envelope having a refractive index, n;

H is the angle of a light ray originating at a point on the center line of the axis of said reflector as measured from the optical axis as said ray enters said envelope;

T is said envelope thickness;

dy/dx is the instantaneous slope of the reflector surface required to achieve a collimated beam;

Z is the angle of incidence and reflection of a ray reflected from said reflector as measured to a line normal to the x-axis;

f is the distance from the origin of coordinates to the axial center of said source of light; and g is the distance between said conjugate focal points.

* * * * *